US006892521B2

(12) United States Patent
Rosenwasser et al.

(10) Patent No.: US 6,892,521 B2
(45) Date of Patent: May 17, 2005

(54) SLALUM CHAIN

(75) Inventors: David Rosenwasser, Norwood, NJ (US); Avraham Moshe Rosenwasser, 100 Rio Vista Dr., Norwood, NJ (US) 07648

(73) Assignee: Avraham Moshe Rosenwasser, Norwood, NJ (US)

( * ) Notice: Subject to any disclaimer, the term of this patent is extended or adjusted under 35 U.S.C. 154(b) by 193 days.

(21) Appl. No.: 10/314,541

(22) Filed: Dec. 9, 2002

(65) Prior Publication Data

US 2003/0106337 A1 Jun. 12, 2003

Related U.S. Application Data

(60) Provisional application No. 60/339,090, filed on Dec. 10, 2001.

(51) Int. Cl.[7] ..... B21L 5/02; F16G 13/00
(52) U.S. Cl. ..... 59/35.1; 72/80; 72/83
(58) Field of Search ..... 59/16, 35.1, 80, 59/83; 140/71.5, 89

(56) References Cited

U.S. PATENT DOCUMENTS 2,549,335 A * 4/1951 Rahthus ..... 59/83
3,137,325 A * 6/1964 Souaya ..... 140/89
3,464,106 A * 9/1969 Barrett ..... 140/71.5
4,493,183 A * 1/1985 Bucefari et al. ..... 59/16
4,651,517 A 3/1987 Benhamou et al.
5,605,038 A 2/1997 Rozenwasser
5,729,081 A * 3/1998 Hoffmann et al. ..... 140/71.5
5,755,088 A * 5/1998 Farsetti ..... 59/35.1
5,966,811 A * 10/1999 Zalusky ..... 59/83
6,338,238 B1 1/2002 Kahan

* cited by examiner

*Primary Examiner*—David Jones
(74) *Attorney, Agent, or Firm*—Katten Muchin Zavis Rosenman

(57) ABSTRACT

A jewelry chain section and a method of forming the same having a spiral, twisted appearance, involves the winding of a wire on a support and the controlled manipulation of such wound wire during or after removal from the support. The wound wire comprises individual spirals that are twisted relative to each other, such that the individual spirals appear in a staggered formation, with the appearance of a chain section being varied by the number of spirals that are twisted at a particular time and the extent or angular dimension of the rotation imparted to such spirals.

32 Claims, 4 Drawing Sheets

SLALUM CHAIN

CROSS REFERENCE TO RELATED APPLICATION

This application claims priority under 35 U.S.C. §119(e) from provisional application 60/339,090 filed Dec. 10, 2001.

FIELD OF THE INVENTION

This application relates to a jewelry chain and method of making the same, and more particularly, to a method of forming jewelry chains having a spiral, twisted appearance.

BACKGROUND OF THE INVENTION

Jewelry chains are usually formed from separate links that are intertwined or interengaged in some fashion to produce an aesthetically appealing article. Chain links come in all shapes, sizes, cross-sections and configurations, depending on the desired final product and the method of making the same. For example, so-called rope chains are commonly created by intertwining solid or hollow links via gaps in such links. The appearance of such rope chain may be further enhanced by polishing, faceting or the like. The methods in which individual links are intertwined via gaps in such links to ultimately form a helical rope-like structure are covered in numerous patent documents, including U.S. Pat. No. 4,651,517 to Benhamou et al. and others.

The inventive links that form the chain of the instant invention are formed from spiral-shaped coils. Typical coil chains are made of turns of spirals that are interconnected one to another. U.S. Pat. No. 5,605,038 to Rozenwasser shows one such typical coil chain. U.S. Pat. No. 6,338,238 to Kahan shows another. In these cases, each coil is formed from a certain number of turns, complete or incomplete, according to a certain formula of turns per coil, coils per link grouping and link groupings per chain. In each case, the coils are unchanged after completion, such that each spiral has uniform dimensional characteristics such as spiral diameter and thickness.

The present invention comprises a different way of forming a jewelry chain section having a spirally twisted appearance that differs from a standard coil chain section. After a standard coil is formed on a mandrel, support or the like, the individual spirals that form the coil section are rotated or twisted relative to each other, resulting in a compilation of spirals that appear staggered when the chain section is viewed as a whole. The twisted movement of the individual spirals is maintained after the chain section is completed, resulting in a twisted chain section that differs significantly in appearance from a standard coil.

SUMMARY OF THE INVENTION

A jewelry chain and method of forming jewelry chains, and in particular jewelry chain sections having a spiral, twisted appearance, involves the winding of a wire on a support and the controlled manipulation of such wound wire during or after removal from the support. The wound wire comprises individual spirals that are eventually twisted relative to each other, such that the individual spirals appear in a staggered formation along the wire section. The appearance of a chain section is varied by the number of spirals that are twisted at a particular time and the extent or angular dimension of the rotation imparted to such spirals.

DETAILED DESCRIPTION OF THE INVENTION

Figure 1:
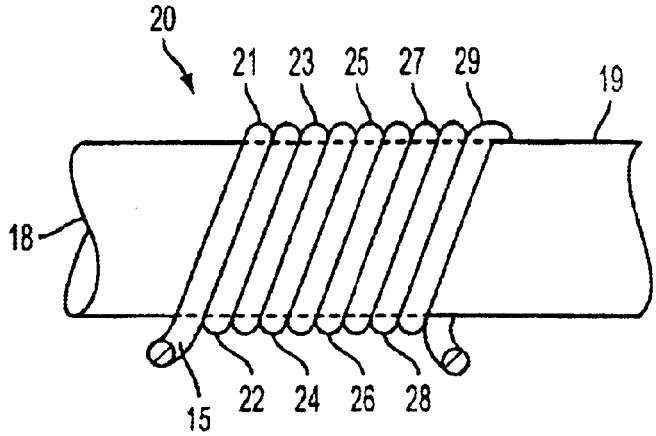
FIG. 1 illustrates the wrapping of a wire around a support to form a wire section in preparation for forming a chain of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

As shown in FIG. 1, an initial wire section 20 having individual spirals 21–29 is formed by winding a wire 15 around a support 18 in a spiral, coil-like fashion. The support 18 can be any cross sectional shape including round, square, etc. Likewise the cross section of the wire 15 can be any shape including round, square, rectangular, etc. Furthermore, the wire 15 can be hollow or solid and can be formed of any material suitable for a jewelry item.

Figure 2:
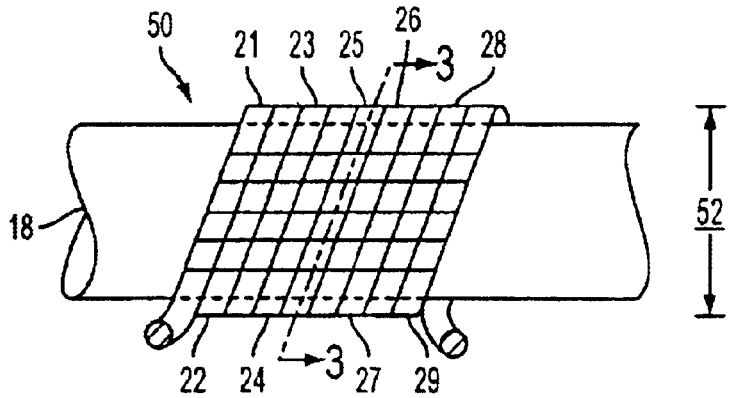
FIG. 2 illustrates the faceting of the wire section of FIG. 1.
Figure 3:
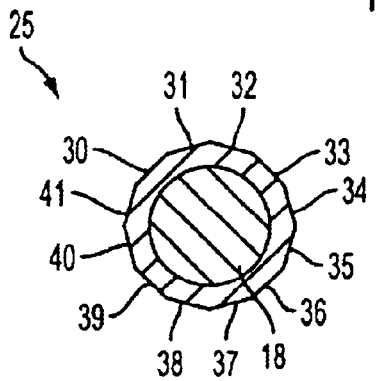
FIG. 3 is a cross section taken through line 3—3 of FIG. 2.

For purposes of explanation and to facilitate understanding of the method of the invention, the wire section 20 is preferably faceted or contoured using any means known in the art to produce a faceted exterior periphery as shown in FIGS. 2 and 3. As will be evident in later figures, the outer periphery of the wire section 20 should preferably be provided with at least two facets or planar surfaces formed around the outer periphery. In the embodiment illustrated in FIG. 2, twelve facets 30–41 are provided around the periphery of the wire section 20, resulting in a faceted wire section 50 having a series of flat surfaces and corners as exemplified in the cross section of spiral 25 as shown in FIG. 3.

Figure 4:
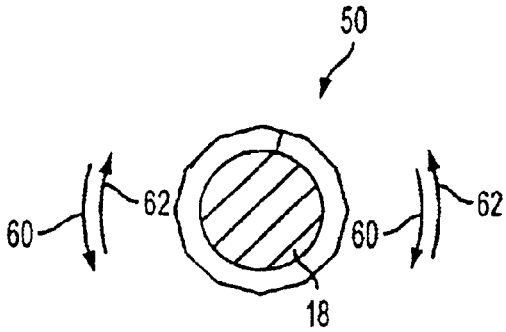
FIG. 4 illustrates the twisting of a spiral of the wire section of FIG. 2.

FIG. 4 illustrates an end view of the wound, faceted wire section 50 of FIGS. 2 and 3 positioned on a support 18. The faceted wire section 50 is then removed from the support 18 in a controlled manner. Specifically, as each spiral portion 21–29 is fed from or otherwise removed from the support 18, such individual spiral portion is twisted or rotated either clockwise (designated by arrows 60 in FIG. 4) or counterclockwise (designated by arrows 62 in FIG. 4) a certain angular distance and with respect to the immediately preceding, adjacent spiral portion that is still retained on the support. For instance, if faceted section 50 is removed from support 18 of FIG. 2 such that spiral 29 is the first spiral to be removed, spiral 29 would be rotated or twisted a certain angular dimension relative to spiral 28 which remains on the support 18 and which is not rotated at the same time as spiral 29. Such rotation is then "memorized" so that the rotated spiral portion remains offset with respect to the adjacent spiral portions as each successive spiral portion is removed from the support. The term "memorized" as used herein means that the rotated spiral portion will not resiliently return to its position before rotation.

Figure 5:
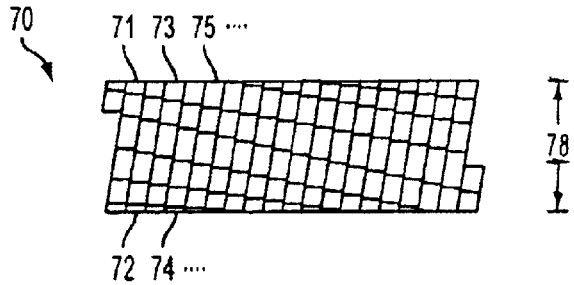
FIG. 5 is a chain section formed in accordance with the method of the invention.

As each spiral portion is removed from the support, it is rotated and "memorized" in the same fashion to produce a chain section 70 as shown in FIG. 5. Thus, the flat surfaces and corners created through the faceting process are no longer lined up as shown in the chain section 50 of FIG. 2, but are instead offset relative to each other as shown in the chain section 70 of FIG. 5. It should be appreciated that the twisting of the individual spirals narrows the resultant chain section, such that the diameter 78 of the twisted chain section 70 is less than the diameter 52 (FIG. 2) of the non-twisted chain section 50.

The "memorizing" of the rotated spiral sections can occur through various means. One method involves the annealing and/or hardening of the actual wire 15 prior to arranging on a support 18, such that the hardened spiral sections 21–29 are able to retain their rotated position without further material treatment. For instance, certain material alloys, i.e., gold-zinc alloys for example, are more receptive to "memorizing" than other alloys under these described conditions. Other methods of "memorizing" involve the material treatment of the spiral sections during their controlled withdrawal from the support and/or after the inventive chain section has been completed. Furthermore, the creation of the chain section and/or the removing and twisting of the spiral sections from the support can be accomplished by hand or through mechanical means.

Each spiral section 71–75, etc. of the faceted chain section 70 illustrated in FIG. 5 is offset with respect to each other. Of course, if each spiral section is rotated by a greater or lesser angular rotation with respect to each adjacent spiral section, then the final chain section would look different than that illustrated in FIG. 5. Thus, FIG. 5 is clearly merely indicative of one embodiment of the present invention.

Figure 6:
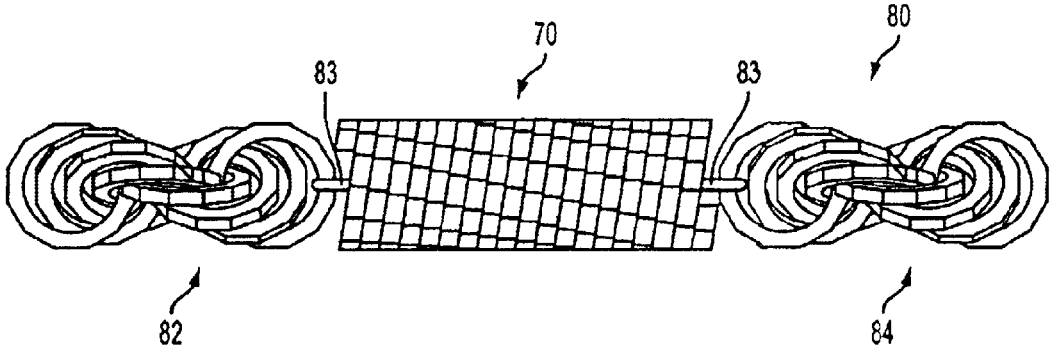
FIG. 6 is a jewelry chain formed from the chain section of FIG. 5.

The chain section 70 of FIG. 5, being illustrative of one embodiment of the present invention, can be dimensioned to form a complete jewelry chain, or it can comprise a section of a jewelry item 80 as shown in FIG. 6, which illustrates a chain section 70 sandwiched between two conventional rope chain sections 82, 84 connected by connecting members 83. Alternatively, a jewelry chain can comprise multiple chain sections formed in accordance with the present invention and multiple chain sections formed in accordance with the teachings of the prior art.

The appearance of the inventive chain section is highly lustrous, and the offset faceted spiral sections improves the aesthetic appearance quite dramatically. For instance, the chain section 50 of FIG. 2 would appear to have a series of longitudinal, lustrous facets situated around the outer periphery of the chain section 50. Thus, as the entire chain section 50 of FIG. 2 is rotated around its longitudinal axis, only one continuous facet would appear to reflect light at a time. However, with the chain section 70 of FIG. 5, the facets are now offset from each other, which results in the chaotic reflectance of light from a variety of offset, scattered surfaces along the entire outer periphery of the section. Consequently, this light reflectance results in a chain section 70 having enhanced brilliance and aesthetic appeal.

Figure 7:
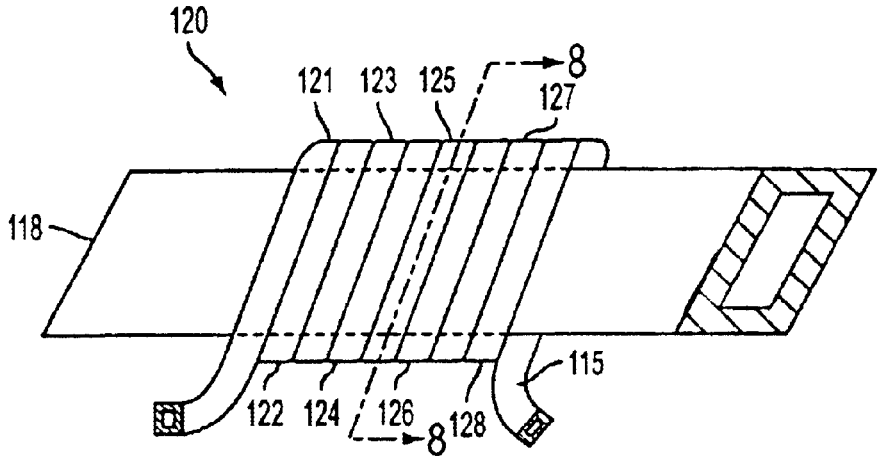
FIG. 7 illustrates the wrapping of a wire around a support to form a wire section in preparation for forming an alternative embodiment of a chain of the present invention.
Figure 8:
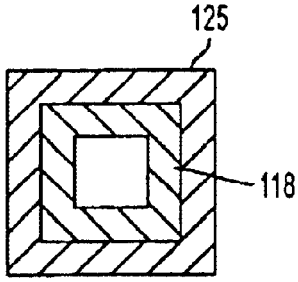
FIG. 8 is a cross section taken through line 8—8 of FIG. 7.

FIGS. 7–8 illustrate an alternative embodiment of the present invention, where the support 118 is not round but is some other shape such as a hollow square cross-sectional support as shown for purposes of explanation. The wire 115 wound around the support 118 into a wire section 120 having spirals 121–128 is hollow with a square cross-section, again shown only for purposes of explanation. Such wound wire section 120 has corners or peaks by virtue of its cross section and the non-round outer periphery of the support 118 as illustrated in the cross-section of spiral 125 in FIG. 8. In some cases, depending on the thickness of the wire and its cross-sectional shape, as any wire is wound around a corner of a non-round support, the wire will acquire a corner on its outer periphery, so that the winding of even a round wire around the support produces the appearance of a faceted spiral without going through the faceting step. Of course, even a non-round wire that is wrapped around a non-round support can be separately faceted as described above and in accordance with methods known in the art.

Again, as noted above, when using a support that is not round, any solid or hollow cross sectional shape could be used, including a square, rectangle, triangle, pentagon, etc. or even a combination of round and non-round surfaces. Likewise the cross section of the wire can be any shape including round, square, rectangular, etc., and it can also be hollow or solid formed of any material suitable for a jewelry item.

Figure 9:
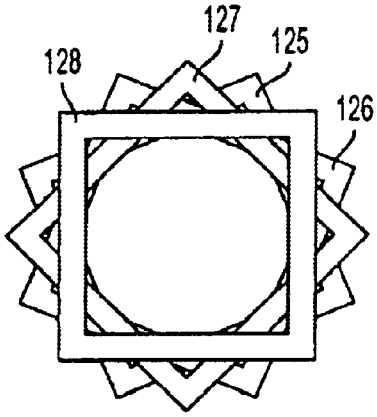
FIG. 9 is an end view of an alternative embodiment of a chain section of the invention.
Figure 10:
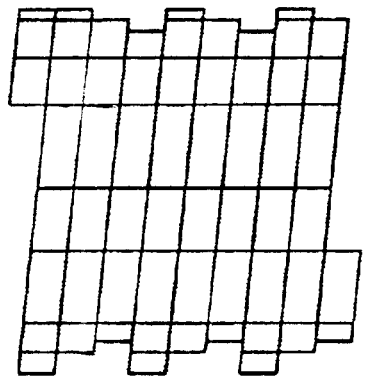
FIG. 10 is a side elevation of the chain section of FIG. 9.

A wire on a support having a plurality of spirals with certain portions that are not round, winds up having corners or points. Then, as each spiral is removed from the support, it is twisted or rotated and "memorized" as described above so that one spiral is offset with respect to the next adjacent spiral. Thus, one embodiment of a chain section 120 (FIG. 7) that has been removed from the support 118 under a controlled manipulation as described above may appear as shown in FIGS. 9 (end view) and 10 (side elevation view). In the chain section of FIGS. 9 and 10, the angle of rotation of each spiral with respect to each adjacent spiral is greater than that illustrated in the chain section of FIG. 5, and this is evident by the spacing of each offset facet or corner portion.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

Figure 11:
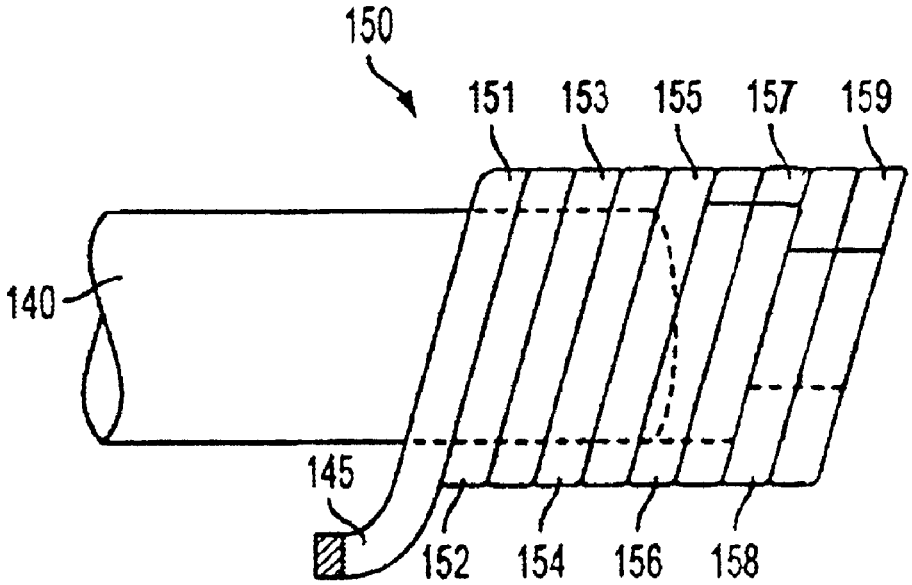
FIG. 11 illustrates the controlled manipulation of a wire section as it is withdrawn from a support in accordance with the invention.

For instance, in the above illustrated embodiments each spiral is twisted or rotated with respect each adjacent spiral. However, more than one spiral section can be removed from a support, twisted and memorized at a time. Thus, as shown in FIG. 11 with a solid, square cross-sectional wire 145 wrapped around a round support 140 and formed into a chain section 150 having spirals 151–159, the spirals 158 and 159 would be removed first from the support 140 and then twisted. Thereafter, the spirals 156 and 157 would be removed from the support 140 and then spirals 156–159 would be twisted together. This process would repeat until the chain section 150 was completely removed from the support 140.

Figure 12:
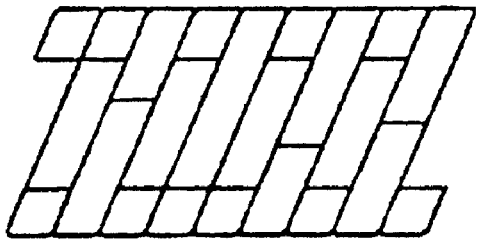
FIG. 12 is an alternative embodiment of a chain section of the invention.

In addition, whether to twist one or more than one spiral section at a time, or whether to twist such spiral section by a certain angular dimension, can be a consistent decision or a random decision, resulting in consistent or random groupings of twisted spirals and/or rotational distances of each twist as shown for example in FIG. 12. Thus, the resultant chain section can have a consistent or a random appearance.

Also, while the above described embodiments illustrate the controlled manipulation of the spirals concurrently with their removal from a support, such controlled manipulation can occur after the wire section has been formed into a coil and removed from the support. Thus, the spirals may be twisted relative to adjacent spirals while the adjacent spirals are supported by means other than a mandrel or support as described herein.

Furthermore, the foregoing describes the invention in terms of embodiments foreseen by the inventor for which an enabling description was available, notwithstanding that insubstantial modifications of the invention, not presently foreseen, may nonetheless represent equivalents thereto.

We claim:

1. A method of forming a jewelry chain section comprising:

a) wrapping a wire around a support to form a chain section having a plurality of spirals, said chain section having an outer periphery, said support having an outer periphery, b) removing said plurality of spirals from said support and rotating at least one spiral in one of a clockwise and a counterclockwise rotation relative to an adjacently positioned spiral after removal of said at least one spiral from said support, and c) producing a jewelry chain section removed from said support and having at least one spiral rotated relative to an adjacent spiral.

2. A method in accordance with claim 1, further comprising the step of contouring said outer periphery of said chain section prior to removing said chain section from said support.

3. A method in accordance with claim 1, wherein said outer periphery of said support is round.

4. A method in accordance with claim 1, wherein said outer periphery of said support has at least one non-round surface.

5. A method in accordance with claim 1, wherein said wire has a solid cross-section.

6. A method in accordance with claim 1, wherein said wire has a hollow cross-section.

7. A method in accordance with claim 1, wherein a plurality of the spirals from said chain section are rotated.

8. A method in accordance with claim 1, wherein at least one grouping of two or more adjacent spirals is rotated together.

9. A method in accordance with claim 8, wherein adjacent groupings of two or more adjacent spirals are rotated.

10. A method in accordance with claim 1, wherein said jewelry chain section is sized to form a jewelry chain.

11. A method in accordance with claim 1, wherein said jewelry chain section as combined with at least one other similarly constructed jewelry chain section to form a jewelry chain.

12. A method in accordance with claim 1, wherein said jewelry chain section is combined with at least one dissimilarly constructed jewelry chain section to form a jewelry chain.

13. A method in accordance with claim 1, wherein said jewelry chain section is combined with at least one rope chain section to form a jewelry chain.

14. A method in accordance with claim 1, wherein said at least one rotated spiral is treated to maintain the relative positioning of said at least one rotated spiral and said adjacently positioned spiral.

15. A method in accordance with claim 1, wherein said jewelry chain section is treated to maintain the relative positioning of said at least one rotated spiral and said adjacently positioned spiral.

16. A method in accordance with claim 1, wherein said rotating occurs by hand.

17. A method in accordance with claim 7, wherein each of said plurality of rotated spirals are rotated by the same angular dimension.

18. A method of forming a jewelry chain section comprising:

a) wrapping a wire around a support to form a chain section having a plurality of spirals, said chain section having an outer periphery, said support having an outer periphery, b) removing said plurality of spirals from said support and rotating at least one spiral relative to an adjacently positioned spiral after removal of said at least one spiral from said support, and c) producing a jewelry chain section removed from said support and having at least one spiral rotated relative to an adjacent spiral, wherein said at least one rotated spiral is rotated after it has been removed from said support while said adjacent spiral remains on said support.

19. A method of forming a jewelry chain section comprising:

a) wrapping a wire around a support to form a chain section having a plurality of spirals, said chain section having an outer periphery, said support having an outer periphery, b) removing said plurality of spirals from said support and rotating at least one spiral relative to an adjacently positioned spiral after removal of said at least one spiral from said support, and c) producing a jewelry chain section removed from said support and having at least one spiral rotated relative to an adjacent spiral, wherein said at least one rotated spiral is rotated after said at least one rotated spiral and said adjacent spiral have been removed from said support.

20. A method of forming a jewelry chain section comprising:

wrapping a wire around a support to form a chain section having a plurality of spirals, said chain section having an outer periphery, said support having an outer periphery, removing said plurality of spirals from said support and rotating at least one spiral relative to an adjacently positioned spiral after removal of said at least one spiral from said support, and producing a jewelry chain section removed from said support and having at least one spiral rotated relative to an adjacent spiral, wherein a plurality of the spirals from said chain section are rotated, and wherein some of said plurality of rotated spirals are rotated by different angular dimensions.

21. A jewelry chain section comprising:

plurality of concentric spirals formed from a continuous length of wire, at least one spiral being rotated in one of a clockwise and a counterclockwise rotation relative to an adjacently positioned spiral.

22. A jewelry chain section in accordance with claim 21, wherein said plurality of concentric spirals are contoured.

23. A jewelry chain section in accordance with claim 21, wherein said wire has a solid cross-section.

24. A jewelry chain section in accordance with claim 21, wherein said wire has a hollow cross-section.

25. A jewelry chain section in accordance with claim 21, wherein more than one spiral is rotated relative to its adjacently positioned spiral.

26. A jewelry chain section in accordance with claim 21, wherein at least one grouping of two or more adjacently positioned spirals is rotated together.

27. A jewelry chain section in accordance with claim 26, wherein adjacent groupings of two or more adjacently positioned spirals are rotated.

28. A jewelry chain section in accordance with claim 21, wherein said jewelry chain section is sized to form a jewelry chain.

29. A jewelry chain section in accordance with claim 21, wherein said at least one rotated spiral is treated to maintain the relative positioning of said at least one rotated spiral and said adjacently positioned spiral.

30. A jewelry chain section in accordance with claim 21, wherein said jewelry chain section is treated to maintain the relative positioning of said at least one rotated spiral and said adjacently positioned spiral.

31. A jewelry chain section in accordance with claim 25, wherein each of said rotated spirals is rotated by the same angular dimension.

32. A jewelry chain section comprising:

a plurality of concentric spirals formed from a continuous length of wire, at least one spiral being rotated relative to an adjacently positioned spiral wherein more than one spiral is rotated relative to its a adjacently positioned spiral and, wherein some of said rotated spirals are rotated by different angular dimensions.

* * * * *